United States Patent [19]

Leoni et al.

[11] 4,289,723

[45] Sep. 15, 1981

[54] PROCESS FOR THE PREPARATION OF REGENERATED CELLULOSE FORMED BODIES FROM SOLUTIONS OF CELLULOSE DERIVATIVES IN ORGANIC SOLVENTS

[75] Inventors: Roberto Leoni, Milan; Alberto Baldini, Garlasco; Gianfranco Angelini, Buscate, all of Italy

[73] Assignee: Snia Viscosa Societa' Nazionale Industria Applicazioni Viscosa S.P.A., Milan, Italy

[21] Appl. No.: 60,544

[22] Filed: Jul. 25, 1979

[30] Foreign Application Priority Data

Jul. 27, 1978 [IT] Italy ..... 26175 A/78

[51] Int. Cl.[3] ..... C09J 3/08; D01F 2/28

[52] U.S. Cl. ..... 264/187; 106/168; 106/169; 106/186

[58] Field of Search ..... 106/168; 264/187

[56] References Cited

U.S. PATENT DOCUMENTS 4,022,631 5/1977 Turbak et al. ..... 106/168

4,129,640 12/1978 Rodier ..... 106/168

*Primary Examiner*—Allan Lieberman

*Attorney, Agent, or Firm*—Ladas & Parry

[57] ABSTRACT

A process for the preparation of regenerated cellulose formed bodies from solutions of cellulose derivatives in organic solvents is disclosed. The cellulose derivatives is firstly precipitated in a coagulating bath constituted of a cellulose non-solvent, non-regenerating organic liquid, then the coagulated body is drawn in subsequent baths and the cellulose is regenerated. The drawing and the regeneration occur, at least in part, concurrently.

8 Claims, No Drawings

PROCESS FOR THE PREPARATION OF REGENERATED CELLULOSE FORMED BODIES FROM SOLUTIONS OF CELLULOSE DERIVATIVES IN ORGANIC SOLVENTS

FIELD OF THE INVENTION

The present invention refers to a process for the preparation of cellulose formed bodies from solutions of cellulose derivatives in organic solvents.

BACKGROUND OF THE INVENTION

It is known to dissolve the cellulose in systems constituted by organic solvents and other substances which may react with the cellulose, and systems of this kind are described in the literature, however they have a purely academic interest since they are not adapted, as far as is now known, for industrial operations.

The system constituted by paraformaldehyde and formaldehyde or DMSO has been recently suggested for this purpose. However it is not easy to obtain, especially in an industrial process, regenerated cellulose formed bodies from such solutions. The most interesting bodies are the filaments of regenerated cellulose or also the films, which must be prepared through coagulation, cellulose regeneration and drawing stages. In U.S. Pat. No. 4,022,631 a system is described and claimed for coagulating and regenerating the cellulose from said solutions, which consists in using as coagulating bath an aqueous solution which is alkaline because of the presence of ammonium or amino compounds or alkaline sulphites or thiosulphates, in particular aqueous ammonia.

In French Patent Application No. 76 22031 it is recalled that it has been attempted to coagulate cellulose solutions by extruding them from a syringe into a methanol bath, but that the product thus coagulated does not withstand the spinning tensions and does not lead to fibres having acceptable properties, so that this is not a method that can be used industrially.

In copending Italian Patent Application No. 20540 A/78 of the same Applicant, a process is described for obtaining solutions of cellulose derivatives in organic solvents different from DMSO, such as e.g. dimethylformamide (DMF), by dissolving the cellulose in a system constituted by paraformaldehyde or formaldehyde and DMSO and thereafter isolating the cellulose derivative thus formed and dissolving it in the desired organic solvent.

In copending Italian Patent Application No. 21844 A/78 of the same Applicant, which is an addition to the aforementioned one, an improvement is described which consists in preparing the cellulose derivative by heating cellulose and paraformaldehyde, with amounts of DMSO which are lower than those required for the preparation of a solution in DMSO.

The solutions prepared according to said patents may be coagulated and the cellulose may be regenerated, e.g., with baths which are alkaline due to the presence of ammonia.

In copending Italian Patent Application No. 21922 A/78 of the same Applicant another process is described for forming solutions of cellulose derivatives in organic solvents, which consists in contacting the cellulose with a strong excess of paraformaldehyde and with a solvent selected from DMF, dimethylacetamide and N-methylpyrrolidone, at an elevated temperature.

These solutions too may be coagulated and the cellulose may be regenerated in the known manner.

Said patents describe various methods for bringing the cellulose in solution in organic solvents with the formation of cellulose derivatives, the exact chemical structure whereof is not known but which are generally designated as "methylol derivatives" and will be so designated herein, without the Applicant being thereby bound to any interpretation with regard to their structure.

SUMMARY OF THE INVENTION

The present invention has as an object an improved method for coagulating said solutions of cellulose derivatives and regenerating the cellulose, thereby to generate formed bodies, in particular filaments and films, of regenerated cellulose, in an industrially efficient way and obtaining bodies having good characteristics.

The process which is the object of the present invention, is characterized in that the cellulose derivative is firstly precipitated in a coagulating bath constituted by a cellulose non-solvent, non-regenerating organic liquid and in that the coagulated body is drawn and the cellulose is regenerated therein in subsequent baths.

Drawing and regeneration might occur in successive stages but preferably they are, at least in part, concurrent.

As cellulose non-solvent, non-regenerating agents those which belong to the classes of the alcohols, ethers, esters, aldehydes, ketones, nitriles, and chlorinated organic liquids are preferred. Examples of such agents are: tetrahydrofurane (THF), dioxane, monoethyl-, monomethyl-, dimethylether of ethylene glycol, $CHCl_3$, acetonitrile, ethyl acetate. The preferred agent, however, is methanol.

DESCRIPTION OF THE PREFERRED EMBODIMENTS OF THE INVENTION

To render a good coagulation and drawing and a regular formation of the formed bodies possible, the cellulose derivative should possess certain characteristics, specifically a certain molar ratio of the formaldehyde units ($CH_2O$) to the anhydroglucosidic units. Therefore the invention preferably comprises forming the solution of the cellulose in the formaldehyde or paraformaldehyde and organic solvent system in one of the ways described in the cited patents and patent applications and subsequently eliminating formaldehyde from the solution until the amount of formaldehyde units is reduced to the minimum necessary to prevent the precipitation of the cellulose. This minimum is normally about one unit of $CH_2O$ or less per anhydroglucosidic unit if DMSO is the solvent and is much higher if other solvents are used. If DMSO is the solvent, said minimum is e.g. 0.8 formaldehyde units per anhydroglucosidic unit, against whereas three or more may be typically found in the solution immediately after preparation. In every specific case, however, the preferred value may be easily determined experimentally by degassing the solution, whereby first of all the free formaldehyde is eliminated and thereafter the decomposition of the methylol derivative begins and bound formaldehyde is given off, and by continuing the degassing until the beginning of the precipitation of cellulose, the formaldehyde content bring determined by titration by known methods. The minimum formaldehyde content which permits the cellulose to be maintained in solution is the preferred value according to the invention.

Thereafter, as has been said, the solution thus obtained is coagulated in a bath of a cellulose non-solvent non-regenerating agent, as hereinbefore specified, which in practice will contain a certain amount of the organic solvent of the cellulose derivative (such as DMSO, DMF, or other) which preferably should be maintained between 0.5 and 30%. The body which forms is drawn to the desired extent and the cellulose is regenerated by means of baths substantially consisting of hot water, which according to the experience of the Applicant is the preferred regenerating agent. The drawing may be effected entirely in the regenerating bath but it may also be conveniently effected at least partially in the non-solvent non-regenerating bath.

In any stage in which the drawing is effected, the drawing may vary between 10% and the maximum degree which the filament may withstand in that phase without breaking. In multiple-stage drawing a part of the drawing occurs when the filament still essentially consists of coagulated methylol derivative and another part when the filament is in a more or less advanced regeneration condition. Frequently, the extent of the total drawing is between about 20% and 120%.

The regeneration may occur in successive stages by passage of the formed bodies through a series of aqueous baths at preferably increasing temperature. The formed bodies, e.g. yarns, are then dried and collected.

The process according to the invention has considerable advantages. Firstly, products having high mechanical characteristics may be obtained. Secondly it is possible to control the characteristics of the products and to vary them according to need so that a range of industrial products may be obtained. Further the products obtained are formed by cellulose derivatives having a higher molecular weight, so that the regenerated cellulose which is obtained at the end has an average molecular weight higher than that obtainable by operating according to the former art and a more reduced dispersion of molecular weights. Finally the process can be regularly carried out on an industrial scale, affording more constant and secure results, and the problems of the recovery of chemical agents from the coagulating baths are reduced, the only problem being constituted by the separation from the coagulating baths of the spinning solvent from the non-solvent non-regenerating agent, in particular methanol.

A number of embodiments of the invention will be now described for purposes of example. Percentages are by weight.

EXAMPLES 1-2-3-4-5-6-7-8

A viscous solution obtained by heating in a closed vessel a suspension of 550 parts of Stroem cellulose, 760 parts of commercial paraformaldehyde and 8690 parts of DMSO at 130° for about 3 hours and subsequently degassing at about 85° and reduced pressure (water pump) until a $CH_2O$/cellulose ratio of about 1 has been obtained, had the following characteristics:

Cellulose %: 5.87

$CH_2O$ %: 1.07 (MS=0.98)

Viscosity at 20° C.: about 330 poise

The symbol "MS" designates the molar ratio of the $CH_2O$ units which can be titrated with the sodium sulphite method, to the cellulose anhydroglucosidic units.

Said solution is filtered and spun through gold-platinum spinnerets provided with 175 orifices having a diameter of 65 micron, under conditions indicated in Table 1.

The yarns have the characteristics indicated in Table 2.

EXAMPLE 9

A solution obtained by treating 80 parts of Stroem cellulose, 106 parts of commercial paraformaldehyde and 1414 parts of DMSO, substantially as described in the preceding example, has furnished the following analytical data:

Cellulose %: 4.93

$CH_2O$ %: 0.77 (MS=0.84)

Viscosity at 20°: about 240 poise

Said solution is filtered and spun through gold-platinum spinnerets provided with 175 apertures having a diameter of 65 micron, under the conditions indicated in Table 1. The yarn has the characteristics indicated in Table 2.

EXAMPLE 10

300 parts of sulphite fir cellulose (Stroem) are heated in an AISI 304 steel closed reactor with 1300 parts of commercial paraformaldehyde (about 95% pure) and 6150 parts of DMF for about 2 hours at 120°-125°. The reactor is then cooled to 114°, it is degassed to room pressure and the elimination of $CH_2O$ is continued at room pressure for about 3 hours, through a large ball valve.

The resulting solution has:

Cellulose %: 4.45

$CH_2O$ %: 7.0

Viscosity at 20°: about 250 poise

Said solution is filtered and spun through gold-platin spinnerets provided with 175 apertures having a diameter of 65 micron, under the conditions indicated in Table 1.

The yarn has the characteristics indicated in Table 2.

TABLE 1

| | SPINNING CONDITIONS (first part) | | | | | | |
|---|---|---|---|---|---|---|---|
| | 1° Coagulating Bath | | Successive Baths | | | | |
| Example | Initial Composition | t° (°C.) | Initial Composition | t° 2° bath | t° 3° bath | t° 4° bath | t° 5° bath |
| 1 | $CH_3OH$ | 14° | $H_2O$ | 65° | 70° | 75° | 80° |
| 2 | $CH_3OH$ | 18° | $H_2O$ | 65° | 70° | 75° | 80° |
| 3 | $CH_3OH$ | 21° | $H_2O$ | 65° | 70° | 75° | 80° |
| 4 | $CH_3OH$ | 23° | $H_2O$ | 65° | 70° | 75° | 80° |
| 5 | $CH_3OH$ | 11° | $CH_3OH$ 2° $H_2O$ 3°,4°,5° | 11° | 65° | 70° | 90° |
| 6 | $CH_3OH$ | 11° | $CH_3OH$ 2° $H_2O$ 3°,4°,5° | 11° | 65° | 70° | 90° |
| 7 | $CH_3OH$ | 11° | $CH_3OH$ 2° $H_2O$ 3°,4°,5° | 11° | 65° | 70° | 90° |
| 8 | $CH_3OH$ | 11° | $CH_3OH$ 2° $H_2O$ 3°,4°,5° | 11° | 65° | 70° | 90° |

TABLE 1-continued

| | | | | | | | |
|---|---|---|---|---|---|---|---|
| 9 | THF | 15° | $H_2O$ | 40° | 60° | 65° | 70° |
| 10 | $CH_3OH$ | 15° | $H_2O$ | 70° | 80° | 80° | 80° |

SPINNING CONDITIONS (second part)

| Example | Total Drawing % | Final wind-up speed | Finish | Dry or wet take-up | Drying | Observations |
|---|---|---|---|---|---|---|
| 1 | 22 | 14 | Lubrostat PAN | dry | hot roll at 120° | |
| 2 | 22 | 14 | Lubrostat PAN | wet | in air as skein | |
| 3 | 22 | 14 | Lubrostat PAN | dry | hot roll at 80° | |
| 4 | 22 | 14 | Lubrostat PAN | we | in air as bobbin | |
| 5 | 92(1) | 25 | Lubrostat PAN | dry | hot roll at 80° | (1) 48% in 2° bath and up to 92% in 3° |
| 6 | 92(1) | 25 | Lubrostat PAN | wet | in air as skein | |
| 7 | 108(2) | 27 | Lubrostat PAN | dry | hot roll at 80° | (2) 48% in 2° bath, up to 94% in 3° and up to 108% in 4° |
| 8 | 108(3) | 27 | Lubrostat PAN | dry | hot roll at 80° | (3) 69% in 2° bath, up to 94% in 3° and up to 108% in 4° |
| 9 | 44 | 14.4 | Lubrostat PAN | wet | in air as skein | |
| 10 | 30 | 13 | Lubrostat PAN | dry | hot roll at 80° | |

TABLE 2

CHARACTERISTICS OF THE YARNS

| EXAMPLE | COUNT DENIERS | TENACITY (gr/den) conditioned | TENACITY (gr/den) humid | ELONGATION % conditioned | ELONGATION % humid | % $CH_2O$ | % S | % N | OSERVATIONS |
|---|---|---|---|---|---|---|---|---|---|
| 1 | 2.63 | 2.25 | 0.70 | 9.6 | 17.1 | none | none | / | |
| 2 | 2.73 | 1.75 | 0.61 | 16.6 | 23.2 | none | none | / | |
| 3 | 2.46 | 2.47 | 0.72 | 10.4 | 16.3 | none | none | / | |
| 4 | 2.48 | 1.96 | 0.59 | 12.7 | 17.6 | traces | none | / | |
| 5 | 1.67 | 3.53 | 1.46 | 9.4 | 12.9 | traces | none | / | |
| 6 | 1.58 | 3.44 | 2.06 | 10.4 | 13.3 | none | none | / | washed as skein with $H_2O$ at 65° and allowed to dry in air |
| 7 | 1.43 | 4.14 | 1.62 | 8.4 | 9.9 | traces | none | / | |
| 8 | 1.36 | 3.79 | 1.53 | 8.0 | 11.2 | traces | none | / | |
| 9 | 1.60 | 1.84 | 0.94 | 15.6 | 20.6 | traces | tra-ces | / | washed as skein with $H_2O$ at 70° and dried in oven at 105° |
| 10 | 0.98 | 1.82 | 0.85 | 9.2 | 13.8 | traces | / | 0.2 | |

We claim:

1. A process for the preparation of regenerated cellulose formed bodies from organic solutions of methylol cellulose derivatives having 0.8 or more formaldehyde units per anhydroglucosidic unit, which comprises first precipitating said cellulose derivative in a coagulating bath consisted of the organic solvent for said cellulose derivatives and a cellulose derivative non-solvent, non-regenerating organic liquid selected from the group consisting of alcohols, ethers, esters, aldehydes, ketones, chlorinated organic liquids and nitriles, and subsequently drawing the cellulose derivative body (in a subsequent hot water bath to an extent) between 10% and the maximum value which said cellulose body can withstand without breaking, and regenerating the cellulose in (said hot water bath) one or more aqueous baths consisting essentially of hot water, wherein the drawing and the regeneration occur, at least in part, concurrently.

2. Process according to claim 1, wherein the drawing occurs, at least to a substantial degree, before the regeneration.

3. Process according to claim 1, wherein the cellulose derivative non-solvent non-regenerating organic liquid is selected from the group consisting of tetrahydrofurane, dioxane, monoethyl ether of ethylene glycol, monomethyl ether of ethylene glycol, dimethyl ether or dimethylether of ethylene glycol, trichloromethane, acetonitrile and ethyl acetate.

4. Process according to claim 1, wherein the cellulose non-solvent non-regenerating organic liquid is methanol.

5. Process according to claim 1, wherein the coagulating bath contains between 0.5 and 30% of the organic solvent of the cellulose derivative solution.

6. Process according to claim 1, wherein the organic solvent of the cellulose derivative solution is selected from the class consisting of dimethylsulphoxide, dimethylformamide, dimethylacetamide and N-methylpyrrolidone.

7. Process according to claim 1, wherein the regeneration occurs in successive stages, by passage of the formed body through a series of aqueous baths at increasing temperatures.

8. Process according to claim 7, wherein the temperature of the baths varies between 40° and 95° C.

* * * * *